US006656651B1

(12) United States Patent
Bender et al.

(10) Patent No.: US 6,656,651 B1
(45) Date of Patent: Dec. 2, 2003

(54) PHOTOCONDUCTIVE MEMBERS

(75) Inventors: Timothy P. Bender, Port Credit (CA); James M. Duff, Mississauga (CA); Cuong Vong, Hamilton (CA); Gordon K. Hamer, Mississauga (CA)

(73) Assignee: Xerox Corporation, Stamford, CT (US)

( * ) Notice: Subject to any disclaimer, the term of this patent is extended or adjusted under 35 U.S.C. 154(b) by 39 days.

(21) Appl. No.: 10/153,715

(22) Filed: May 22, 2002

(51) Int. Cl.[7] ..... G03G 5/047

(52) U.S. Cl. ..... 430/58.8; 430/74; 546/37; 252/600; 399/297

(58) Field of Search ..... 430/58.8, 74; 546/37; 252/600; 399/297

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,555,463 | A | 11/1985 | Hor et al. | 430/59 |
| 4,587,189 | A | 5/1986 | Hor et al. | 430/59 |
| 4,709,029 | A | 11/1987 | Spietschka et al. | 544/125 |
| 5,336,577 | A | 8/1994 | Spiewak et al. | 430/59 |
| 5,473,064 | A | 12/1995 | May et al. | 540/141 |
| 5,493,016 | A | 2/1996 | Burt et al. | 540/139 |
| 5,645,965 | A | 7/1997 | Duff et al. | 430/59 |
| 5,756,245 | A | 5/1998 | Esteghamatian et al. | 430/59 |
| 6,162,571 | A | 12/2000 | Duff et al. | 430/59.1 |
| 6,165,661 | A * | 12/2000 | Hsiao et al. | 430/59 |
| 6,287,738 | B1 * | 9/2001 | Duff et al. | 430/59.1 |
| 6,464,902 | B1 * | 10/2002 | Gaynor et al. | 252/600 |

* cited by examiner

*Primary Examiner*—John Goodrow
(74) *Attorney, Agent, or Firm*—E. O. Palazzo

(57) ABSTRACT

A component containing a supporting substrate, and thereover a layer comprised of a alkylimido-monobenzamidazole-perinone-perylene or a bisalkylimido-perinone-perylene of the alternative following formulas wherein each of $R_1$, $R_2$ and $R_3$ are, for example, independently alkyl or aryl.

35 Claims, No Drawings

PHOTOCONDUCTIVE MEMBERS

RELATED PATENTS

Disclosed in U.S. Pat. No. 5,645,965, the disclosure of which is totally incorporated herein by reference, are photoconductive imaging members with perylenes and a number of charge transport molecules, such as amines.

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1', 2'-b)anthra (2,1,9-def: 6,5,10-d'e'f')diisoquinoline-6, 11-dione and bisbenzimidazo(2,1 -a:2', 1'-a) anthra(2,1,9-def:6,5,10-d'e'f') diisoquinoline-10,21-dione, and thereover a charge transport layer.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably comprised of a mixture of bisbenzimidazo (2,1-a-1', 2'-b)anthra(2,1 ,9-def:6,5,1 0-d'e'f') diisoquinoline-6,1 1 -dione and bisbenzimidazo(2, 1-a:2', 1 '-a)anthra(2,1,9-def:6,5,10-d'e'f') diisoquinoline-10, 21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,645,965, the disclosure of which is totally incorporated herein by reference, are photoconductive imaging members containing perylenes.

The appropriate components, and processes of the above recited patents may be selected for the present invention in embodiments thereof.

BACKGROUND

This invention is generally directed to imaging members, and more specifically, there is disclosed layered photoconductive imaging members comprised of perinone/perylene dimers, such as alkylimido-monobenzamidazole-perinone-perylene dimers. Photoconductive imaging members containing the aforementioned dimers possess in embodiments a number of advantages as indicated herein, inclusive of being sensitive to blue wavelengths of, for example, about 400 nanometers. The photogenerating layer, which can be exposed to light of the appropriate blue wavelengths simultaneously, or sequentially exhibits, for example, excellent cyclic stability, independent layer discharge, acceptable dark decay characteristics, permits tuning of the electrical properties of the imaging member, and enables substantially no adverse changes in performance over extended time periods. Processes of imaging, especially xerographic imaging and printing, including digital are also encompassed by the present invention.

More specifically, the layered photoconductive imaging members illustrated herein can be selected for a number of different known imaging and printing processes including, for example, multicopy/fax devices, electrophotographic imaging processes, especially xerographic imaging and printing processes wherein negatively charged or positively charged images are rendered visible with toner compositions of an appropriate charge polarity. The imaging members as indicated herein are in embodiments sensitive in the wavelength region of, for example, from about 900 to about 300 nanometers, and in particular, from about 350 to about 450 nanometers. Moreover, the imaging members of the present invention in embodiments can be selected for color xerographic imaging applications where several color printings can be achieved in a single pass.

REFERENCES

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of certain perylene pigments as photoconductive substances is also known. There is thus disclosed in Hoechst European Pat. No. Publication 0040402, DE3019326, the use of N,N'-disubstituted perylene-3,4,9,10-tetracarboxyldiimide pigments as photoconductive substances. Specifically, for example, there is disclosed in this publication N, N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs.

In accordance with the disclosure of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component as a hole transport layer.

Illustrated in U.S. Pat. No. 5,336,577, the disclosure of which is totally incorporated herein by reference, are single layered imaging members.

The appropriate components and processes of the above art patents may be selected for the present invention in embodiments thereof.

SUMMARY

It is a feature of the present invention to provide imaging members with many of the advantages illustrated herein.

Another feature disclosed relates to the provision of photoresponsive imaging members with excellent photosensitivity to blue light radiations.

It is yet another feature disclosed that relates to layered photoresponsive imaging members with a sensitivity to blue light, and which members possess in embodiments tunable and preselected electricals, acceptable dark decay characteristics, and high photosensitivity.

Moreover, another feature disclosed relates to the provision of improved layered photoresponsive imaging members comprised of perinone/perylene dimers with photosensitivity to blue light, for example, from about 350 to about 450 nanometers, and wherein blue light is believed to be absorbed by the perinone moiety, and the energy resulting is transferred to or radiated to the perylene chromaphore.

It is yet another feature disclosed wherein there is provided photoconductive imaging members with a photogenerating layer comprised of perinone/perylene dimers photogenerating components, and which layer can be deposited on a supporting substrate.

In further features disclosed there are provided perinone/perylene dimers wherein there is chemically bonded to a perinone blue light sensitive component or chromaphore to a know photogenerator, such as a perylene, and which members exhibited in embodiments increased photosensitivity to blue light as compared to the perinone or perylene alone; and photoresponsive, or photoconductive imaging members which can be selected for imaging processes including color xerography.

Aspects of the present invention relate to a component such as, for example, a photoconductive imaging member comprised of supporting substrate, and thereover a layer comprised of a photogenerator comprised of a perinone/perylene dimer of, for example, alkylimido-monobenzamidazole-perinone-perylenes, bisalkylimido-perinone-perylenes, alkylimido-monobenzamidazole-perylene-perinones or monobenzam idazole-monobenzamidazole-perinone-perylenes of the following general formulas

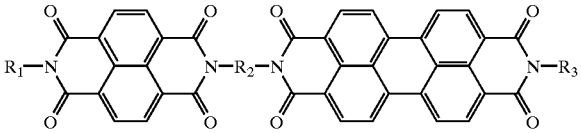

or

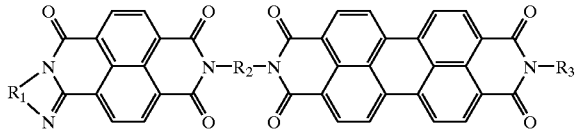

or

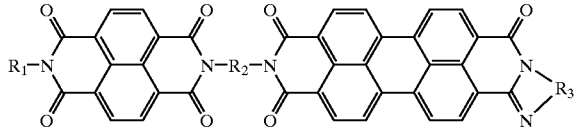

or

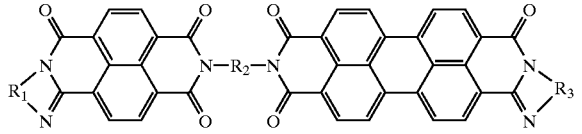

wherein $R_1$ is, for example, alkyl with, for example, from 1 to about 25, and more specifically, from 1 to about 10 carbon atoms, inclusive of a substituted or unsubstituted alkyl, branched alkyl with, for example, from 1 to about 26, and more specifically, from 1 to about 12 carbon atoms, cycloalkyl with, for lo example, from 1 to about 25, and more specifically, from 1 to about 10 carbon atoms, or aryl with, for example, from 6 to about 36 carbon atoms, such as phenyl, naphthyl, or a higher polycyclic aromatic exceeding 36 carbon atoms; $R_2$ is, for example, alkyl, a branched alkyl, cycloalkyl, or aryl, such as phenyl, naphthyl, a higher polycyclic aromatic or $R_1$; and $R_3$ is, for example, alkyl, branched alkyl, cycloalkyl, or aryl, such as phenyl, naphthyl, or a higher polycyclic aromatic, such as anthracene or $R_1$; and $R_1$, R2 and R3 can contain a total number of carbons of from 1 and about 50, and more specifically, from 1 to about 12.

Specific examples of perinone/perylene dimers include those of the following formulas

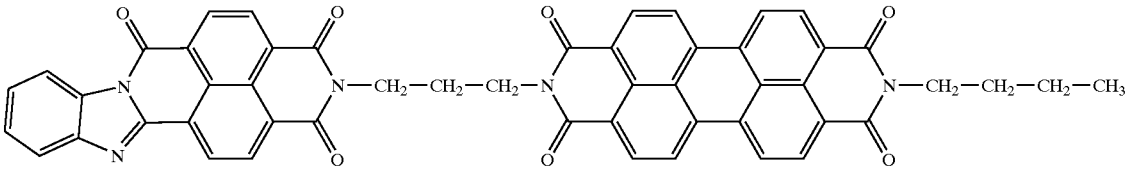

-continued

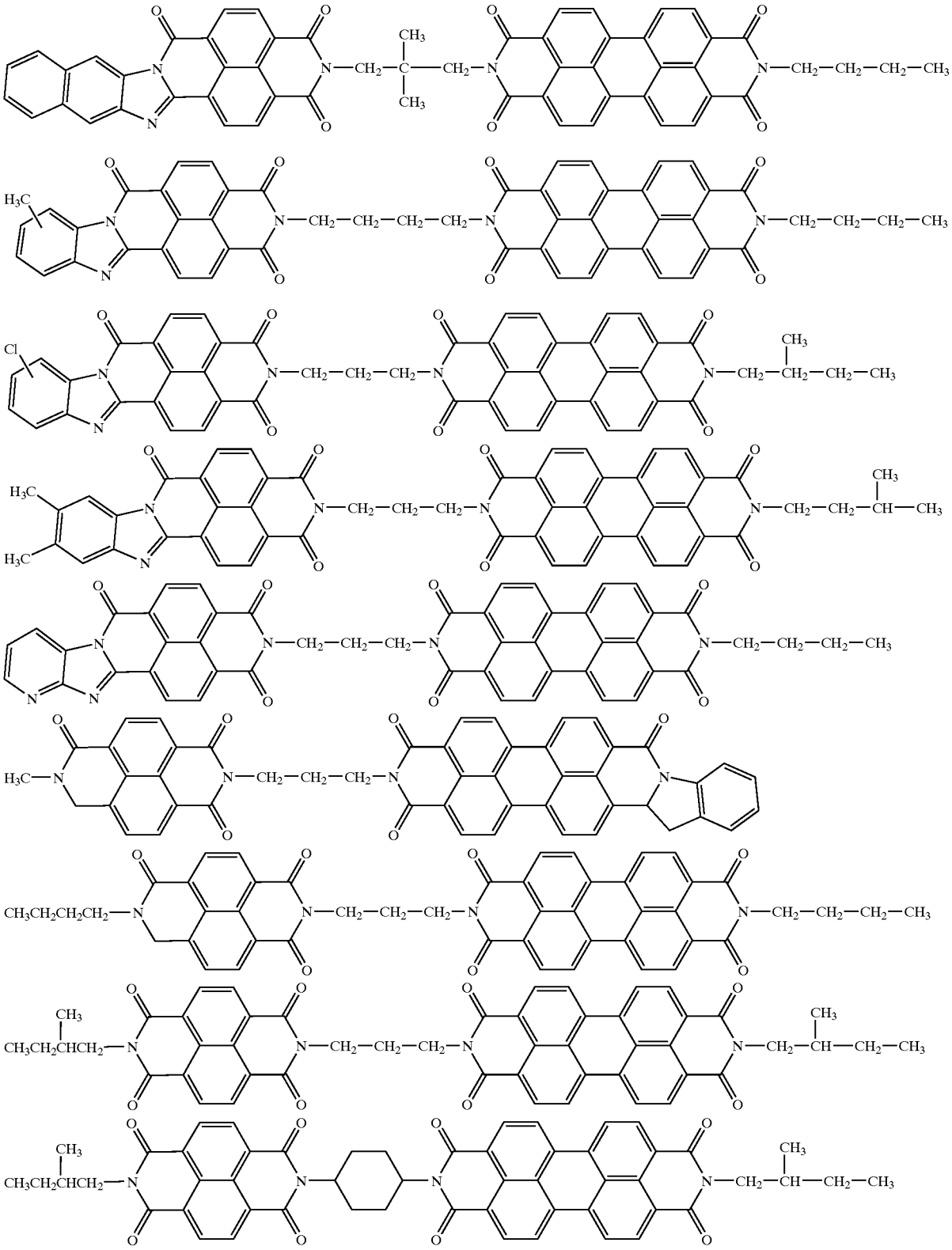

The perinone/perylene dimers can be prepared by a number of methods, such as the reaction of a naphthalene tetracarboxylic acid and a 1,2-phenylene diamine to form an intermediate product, which may or may not be isolated, and then a further reaction with a monoimido-monoaminoimido perylene in accordance with, for example, the following convergent reaction schemes

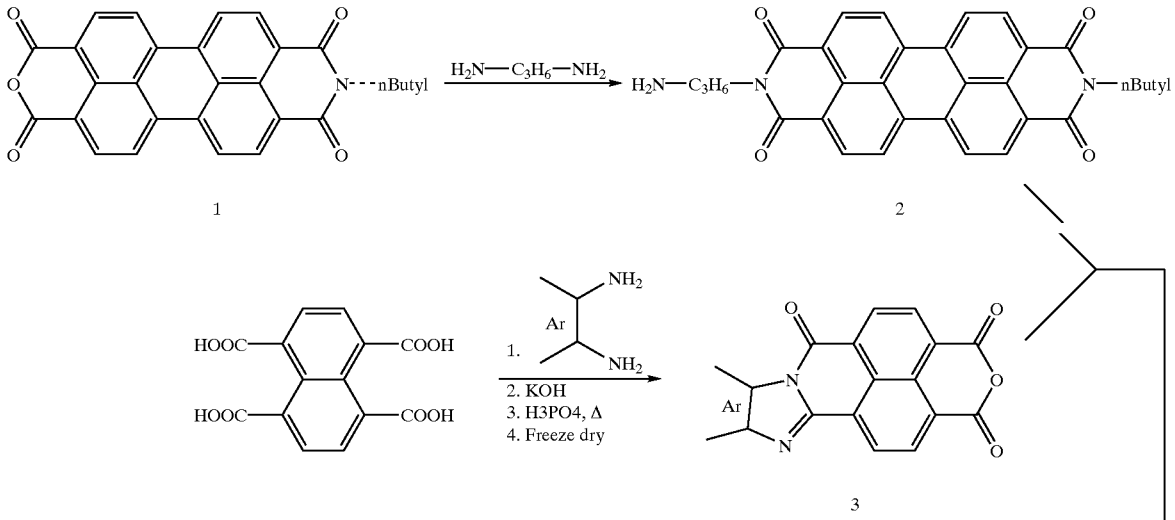
Ar = for example 3,4-dimethyl-1,2-phenylene or 2,3-naphthalene
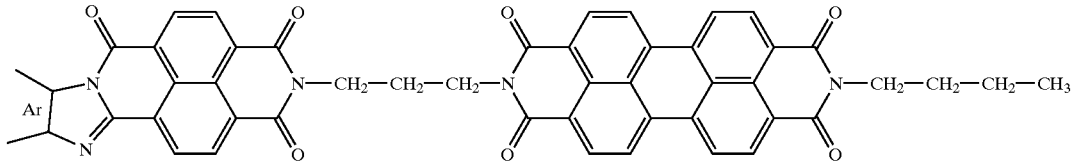
Perinon-Perylene Dimer Photogenerator Material (4)
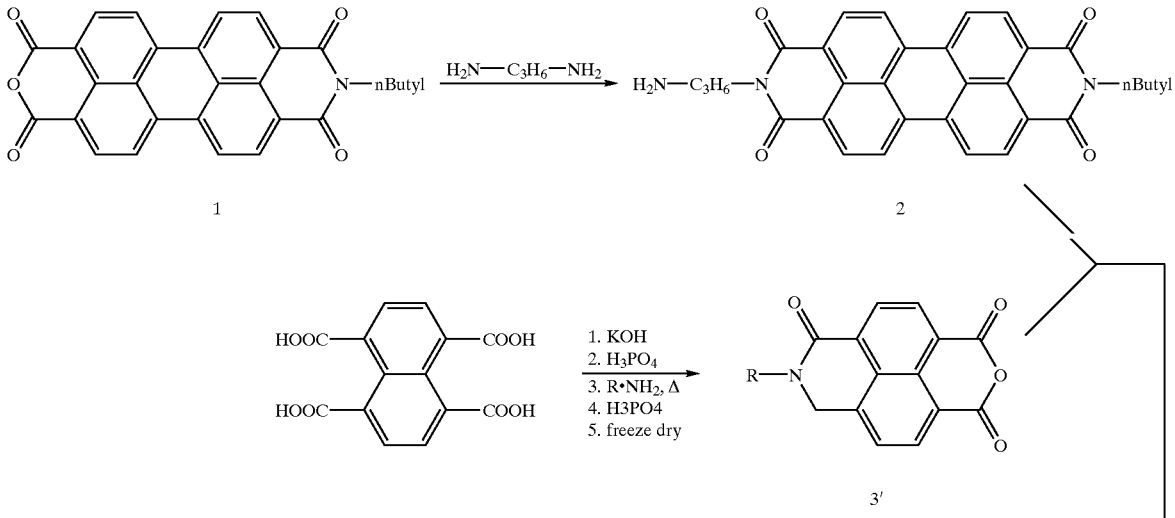
R = for methyl, ethyl, butyl, isobutyl, 3-methylbutyl etc. …
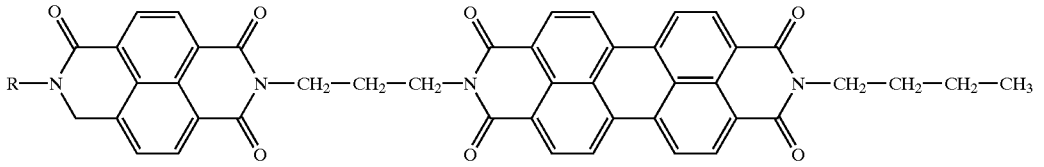
Perinone-Perylene Dimer Photogenerator Material (4′)

For example, in embodiments monoimido-monoanhydride perylene (1) was prepared according to the processes with minor adaptations thereof as illustrated in Troster, H; *Dye and Pigments*, 1983, 4, 171–177 and Spietschka, E.; Troster, H.; and U.S. Pat. No. 4,709,029, the disclosure of which is totally incorporated herein by reference, the structure and purity of the perylene which was confirmed primarily using 1H and 13C nuclear magnetic resonance spectroscopy. Monoimido-monoaminoimido perylene (2) was prepared according to U.S. Pat. No. 6,162,571, the disclosure of which is totally incorporated herein by reference, the structure and purity of which was confirmed primarily using 1H and 13C nuclear magnetic resonance spectroscopy. More specifically, a monobenzamidazole monoanhydride perinone can be prepared by placing naphthalene tetracarboxylic acid along with between about 0.1 and about 2 equivalents, or more specifically, between about 1 and about 1.2 equivalents of an appropriately substituted 1,2-phenylene diamine in N,N-dimethylformamide and heating at elevated temperatures. Upon cooling to about room temperature, about 22° C. to about 25° C., the solid resulting is separated and then dispersed in aqueous potassium hydroxide solution from which the insolubles are filtered and on acidification with concentrated phosphoric acid, heating, isolating and freeze drying provides the desired compound 3.

Monoimide monoanhydride perinone can also be prepared by the dissolution of naphthalene tetracarboxylic acid in an aqueous potassium hydroxide to form a monopotassium salt thereof after buffering with concentrated phosphoric acid. The subsequent addition of from about 1 to about 10 molar equivalents, and more specifically, from about 1 to about 1.2 molar equivalents of a water soluble amine; heating the mixture to up to about 90° C., and further acidification of the mixture resulting after heating results in the formation of compound 3' which can be isolated by hot or cold filtration or other suitable means.

Heating of the above isolated compound 2 and either isolated compounds 3 or 3' at a temperature of from about 100° C. to about 200° C. in a suitable solvent results in the formation and isolation on cooling of a perinone-perylene dimmer compound 4' of the type shown herein but not limited thereto. Compounds of the type 4 or 4' illustrated herein can be purified by boiling and hot filtering in a suitable solvent such as but not limited to N,N-dimethylformamide.

In embodiments of the present invention there is provided a member wherein the photogenerating layer is of a thickness of from about 5 to about 60 microns; a member wherein the photogenerator component amount is from about 0.05 weight percent to about 30 weight percent with from about 75 weight percent to about 90 weight percent of binder, and wherein the total of the components is about 100 percent; and wherein dimer layer is dispersed in from about 50 weight percent to about 75 weight percent of a polymer binder; a member wherein that absorbs light of a wavelength of from about 375 to about 450 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerator binder is selected from the group consisting of polyesters, polyvinyl butyrals, polycarbonates, polystyrene-b-polyvinyl pyridine, and polyvinyl formulas; an imaging member wherein the charge transport is a hole transport of N,N'-diphenyl-N,N-bis(3-methyl phenyl)-1,1'-biphenyl-4,4'-diamine molecules; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 375 to about 425 nanometers; an imaging apparatus containing a charging component, a development component, a transfer component, and a fixing component and wherein the apparatus contains a photoconductive imaging member comprised of supporting substrate, and thereover a layer comprised of a perinone/perylene photogenerating pigment and a hole transport layer; an imaging member further containing an adhesive layer and a hole blocking layer; an imaging member wherein the blocking layer is contained as a coating on a substrate and wherein the adhesive layer is coated on the blocking layer; an imaging member further containing an adhesive layer and a hole blocking layer; a method of imaging which comprises generating an electrostatic latent image on the imaging member of the present invention, developing the latent image, and transferring the developed electrostatic image to a suitable substrate; and a color method of imaging which comprises generating an electrostatic latent image on the imaging member, developing the latent image, transferring and fixing the developed electrostatic image to a suitable substrate; and photoconductive imaging members with a perinone/perylene dimer, and wherein the perylene is BZP perylene, which BZP is preferably comprised of a mixture of bisbenzimidazo(2,1 -a-i ',2'-b)anthra(2,1,9-def:6,5,10-d'e'f') diisoquinoline-6,11 -dione and bisbenzimidazo(2,1 -a:2', 1'-a)anthra(2,1,9-def: 6,5,10-d'e'f')diisoquinoline-10,21-dione, reference U.S. Pat. No. 4,587,189, the disclosure of which is totally incorporated herein by reference.

The photogenerating components and the charge transport components are in embodiments dispersed in a suitable binder, such as polycarbonates, polyesters, polyvinylbutaryl, polysiloxanes and polyurethanes. The photogenerating pigments can be present in various amounts, such as, for example, from about 0.05 weight percent to about 30 weight percent and preferably from about 0.05 weight percent to about 5 weight percent and the polymer binder can be present in an amount of from about 25 weight percent to about 75 weight percent. The thickness of this layer can be, for example, from about 5 microns to about 60 microns and preferably from about 1 micron to about 10 microns.

There may also be selected for the members of the present invention a suitable adhesive layer, preferably situated between the substrate and the single layer, examples of adhesives being polyesters, such as VITEL® PE100 and PE200 available from Goodyear Chemicals, and especially MOR-ESTER 49,0000® available from Norton International. This adhesive layer can be coated on to the supporting substrate from a suitable solvent, such as tetrahydrofuran and/or dichloromethane solution, to enable a thickness thereof ranging, for example, from about 0.001 to about 5 microns, and more specifically, from about 0.1 to about 3 microns.

The photoconductive imaging members can be economically prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating and charge transport components for the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours under stationary conditions or in an air flow. The coating can be accomplished to provide a final coating thickness of from about 0.01 to about 30 microns after drying. The fabrication conditions for a given photoconductive layer can be tailored to achieve optimum performance and cost in the final members. The coating in embodiments of the present invention can also be accomplished with spray, dip or wire-bar methods such that the final dry thickness of the photogenerating layer is, for example, from about 3 to about 50 microns and preferably from about 5 to about 30 microns after being dried at, for example, about 40° C. to about 150° C. for about 5 to about 90 minutes.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as, for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as MAKROLON®.

The thickness of the substrate layer depends on many factors, including economical considerations, thus this layer may be of substantial thickness, for example over 3,000 microns, or of a minimum thickness. In one embodiment, the thickness of this layer is from about 75 microns to about 300 microns.

Generally, the thickness of the layer in contact with the supporting substrate depends on a number of factors, including the thicknesses of the substrate, and the amount of components contained in the single layer, and the like. Accordingly, the layer can be of a thickness of, for example, from about 3 microns to about 50 microns, and more specifically, from about 5 microns to about 30 microns. The maximum thickness of the layer in embodiments is dependent primarily upon factors, such as photosensitivity, electrical properties and mechanical considerations. The binder resin present in various suitable amounts, for example from about 5 to about 70, and more specifically, from about 10 to about 50 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly (vinyl alcohol), polyacrylonitrile, polystyrene, and the like. In embodiments of the present invention, it is desirable to select as the single layer coating solvents, such as ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

As optional adhesives usually in contact with the supporting substrate, there can be selected various known substances inclusive of polyesters as indicated herein, polyamides, poly(vinyl butyral), poly(vinyl alcohol), polyurethane and polyacrylonitrile. This layer is of a suitable thickness, for example a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layer in contact with the photogenerating layer include molecules of the following formula

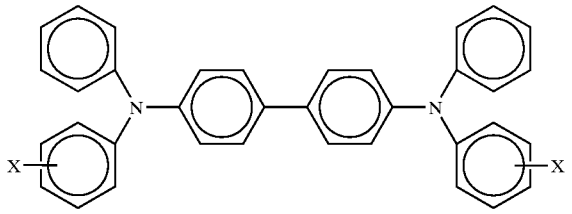

wherein X is an alkyl group, a halogen, or mixtures thereof, especially those substituents selected from the group consisting of Cl and $CH_3$.

Examples of specific aryl amines are N,N'-diphenyl-N,N'-bis (alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport molecules can be selected, reference for example U.S. Pat. Nos. 4,921,773 and 4,464,450, the disclosures of which are totally incorporated herein by reference.

Polymer binder examples for the hole transport molecules include components as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000 with a molecular weight, preferably $M_w$ of from about 50,000 to about 100,000 being particularly preferred.

Also, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example, by heat, the image thereto. In those environments wherein the member is to be used in a printing mode, the imaging method is similar with the exception that the exposure step can be accomplished with a laser device or image bar.

The following Examples are being provided. Parts and percentages are by weight unless otherwise indicated. A Comparative Example is also provided.

EXAMPLE I

Naphthalene tetracarboxylic acid (60.8 grams, 0.2 moles) and 6 grams zinc(II)acetate dihydrate was placed in 800 milliliters of N,N-dimethylformamide and heated to the boiling temperature. 1,2-Phenylene diamine (21.6 grams, 0.2 moles) was then added as a powder over a 2 hour period, and refluxing was continued for 1 hour after complete addition. A solid was collected on cooling which was isolated by an appropriate know method. The solid was then placed in water (1 liter) containing potassium hydroxide (33 grams) and heated to 80° C. for 2 hours at which point any insoluble materials were filtered and discarded. The filtrate was acidified by the addition of phosphoric acid (35 milliliters concentrated) and. the resulting suspension was heated at 90° C. for 2 hours. The solid resulting was removed by a suitable method and freeze dried to yield the desired monobenzamidazole monoanhydride perinone (compound of type 3, 40.46 grams). The purity and absolute identity of the compound was confirmed using primarily $^{1}H$ and $^{13}C$ nuclear magnetic resonance spectroscopy (using dimethylsulfoxide-$d_6$ as the solvent).

EXAMPLE II

Naphthalene tetracarboxylic acid (121.6 grams, 0.4 moles) was added to water (1.2 liters) containing sodium hydroxide (64 grams) and stirred for 1 hour at which time any insoluble materials were filtered by a suitable known method. Concentrated phosphoric acid (46.1 grams, 0.4 moles) was then added and an off-white precipitate typically formed which on heating to 90° C. converts back into solution. 2-Methylbutylamine (50 milliliters, excess) was subsequently added and the temperature of the reaction was maintained at 95° C. for 4 hours at which time any insoluble material was filtered from the solution while hot. Concentrated phosphoric acid (40 milliliters) was then added while the filtrate was still hot. The filtrate was then heated at 95° C. for 1 hour, cooled to 70° C. and the solids resulting were collected by a suitable known means, washed with water (1 liter) and freeze dried to provide the desired monoimido monoanhydride perinone (compound of type 3', 95.81 grams). The purity and absolute identity of the compound was confirmed using primarily $^{1}H$ and $^{13}C$ nuclear magnetic resonance spectroscopy (using dimethylsulfoxide-$d_6$ as the solvent).

EXAMPLE III 3,4-Dimethylmonobenzamidazole monoanhydride perinone (compound of type 3, 4.95 grams) and monobuytlimido-monoaminopropylimido-perylene (compound of type 2, 4 grams) were placed in N-methylpyrrolidinone (230 milliliters; high dilution needed to maintain adequate stirring) and heated at 200° C. under a blanket of argon for 2.5 hours after which time the solid materials resulting were isolated on cooling by vacuum filtration, washed with N-methylpyrrolidinone/methanol (¼, 500 milliliters) and then methanol (500 milliliters). The compound obtained of type 4 above could be purified to xerographic grade by the following successive treatments: boiling DMF (2×150 milliliters, 45 minutes each); water (1×150 milliliters, room temperature, about 22° C. to about 25° C., 45 minutes); 2 percent potassium hydroxide solution (1×150 milliliters, 60° C., 45 minutes); water (2×15 milliliters, 60° C., 45 minutes); methanol (2×150 milliliters, 40° C., 45 minutes); to provide the desired compound of type 4 (5.83 grams) on drying in vacuum overnight, about 18 to 20 hours throughout, (10 millimeters Hg, 60° C.). The purity and absolute identity of the compound was confirmed using primarily $^{1}H$ and 13C nuclear magnetic resonance spectroscopy (solvent either 10:1 chloroform-d:trifluoroacetic acid-d or 10:1 benzene-$d_6$:trifluoroacetic acid-d).

EXAMPLE IV

Photoresponsive imaging members were fabricated with the perinone/perylene pigments obtained by the above synthesis Examples. These photoresponsive imaging members were generally known as dual layer photoreceptors containing a photogenerator layer, and thereover a charge transport layer. The photogenerator layer was prepared from a pigment dispersion as follows: 0.2 gram of the perinone/perylene dimer pigment product was mixed with 0.05 gram of polyvinyl carbazole polymer and 10.5 milliliters of methylene chloride in a 30 milliliter glass bottle containing 70 grams of ⅛-inch stainless steel balls. The bottle was then placed on a roller mill, and the dispersion present was milled for 4 days. Using a film applicator of 1.5 mil gap, the resulting pigment dispersion was then coated to form a photogenerator layer on a titanized MYLAR® substrate of 75 microns in thickness which substrate contained thereon a silane layer, 0.1 micron in thickness, and thereover, an E.I. DuPont Company 49,000 polyester adhesive in a thickness of 0.1 micron. Thereafter, the photogenerator layer formed was dried in a forced air oven at 135° C. for 20 minutes. Photogenerator layers for each separate device were each overcoated with charge transport layer prepared as follows. A transport layer solution was prepared by mixing 2.025 grams of polycarbonate (PC(Z)400), 0.675 grams of tritoylamine, 0.675 grams of 1,1-bis(N,N-ditoyl-4-aminophenyl) cyclohexane and 15.38 grams of methylene chloride. The resulting solution was coated onto the above photogenerating layer using a film applicator of 10 mil gap. The resulting photoconductive member was then dried at 135° C. in a forced air oven for 20 minutes. The final dried thickness of transport layer was 25 microns. The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value Vo of about —800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})N_{ddp}$. The desired wavelength and energy of the exposed light was determined by the type of filters placed in front of the lamp. The monochromatic light photosensitivity was determined using a narrow band-pass filter. The photosensitivity of the imaging member was usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller is the $E_{1/2}$ value. The device was finally exposed to an erase lamp of appropriate light intensity and any residual potential ($V_{residual}$) was measured. The imaging members were tested with an exposure monochromatic light at a wavelength of 800 nanometers and an erase broad-band light with the wavelength of about 400 to about 800 nanometers. The imaging members were cycled continuously for 10,000 cycles of charge, expose and erase and changes in $V_{ddp}$ and $V_{residual}$ were measured. The imaging member could be charged both negatively and positively and photodischarged.

A photoconductive imaging member fabricated by the process of Example IV had a dark decay of 64.8 volts/second, an $E_{1/2}$ of 9.69 ergs/cm$^2$ and the $V_{residual}$ was 19.7 volts for negative charging. The member was sensitive to blue light of a wavelength of 400 nanometers, and which wavelength was generated from a 400 nanometer single-band pass filter placed in front of a xenon lamp.

Other embodiments and modifications of the present application may occur to those skilled in the art subsequent to a review of the information presented herein; these embodiments and modifications thereof, equivalents thereof, similar equivalents, substantial equivalents, and the like, are also included within the scope of the claims.

What is claimed is:

1. A photoconductive member component comprised of a supporting substrate, and thereover a photogenerating layer comprised of an alkylimido-monobenzamidazole-perinone-perylene or a bisalkylimido-perinone-perylene of the alternative following formulas

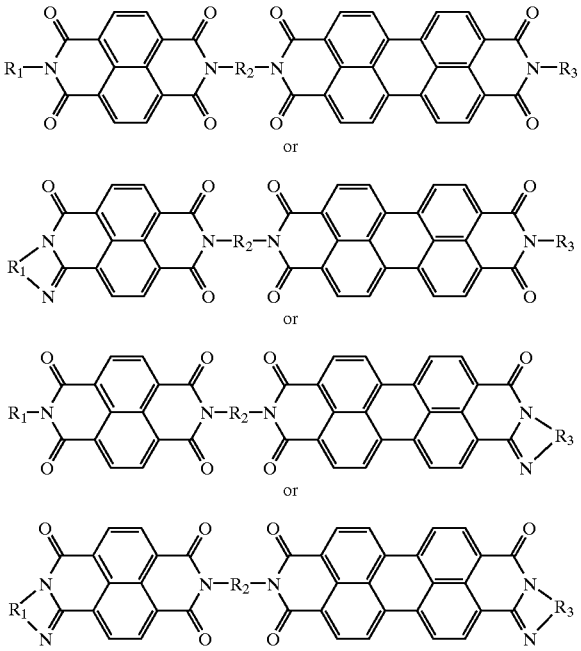

wherein each of $R_1$, $R_2$ and $R_3$ are independently alkyl or aryl, and a charge transport layer component.

2. A component in accordance with claim 1 wherein said photogenerating layer is of a thickness of from about 1 to about 20 microns, and wherein said charge transport layer is of a thickness of from about 25 to about 100 microns, and wherein each R is alkyl.

3. A component in accordance with claim 1 wherein said photogenerating layer is of a thickness of from about 1 to about 20 microns, and wherein said charge transport layer is of a thickness of from about 25 to about 100 microns, and wherein each of said layers contains from about 10 weight percent to about 75 weight percent of a polymer binder, and wherein each R is alkyl.

4. A component in accordance with claim 1 wherein the photogenerating component is present in an amount of from about 5 to about 10 weight percent.

5. A component in accordance with claim 4 wherein the thickness of said layer is from about 1 to about 5 microns.

6. A component in accordance with claim 1 wherein said photogenerator and said charge transport components are contained in a polymer binder.

7. A component in accordance with claim 6 wherein said binder is present in an amount of from about 50 to about 90 percent by weight.

8. A component in accordance with claim 1 wherein the photogenerating layer absorbs light of a wavelength of from about 375 to about 425 nanometers.

9. A component in accordance with claim 1 wherein the supporting substrate is comprised of a conductive substrate comprised of a metal.

10. A component in accordance with claim 9 wherein the conductive substrate is aluminum, aluminized polyethylene terephthalate or titanized polyethylene terephthalate.

11. A component in accordance with claim 6 wherein the binder is selected from the group consisting of polyesters, polyvinyl butyrals, polycarbonates, polystyrene-b-polyvinyl pyridine, and polyvinyl formulas.

12. A component in accordance with claim 1 wherein said charge transport is comprised of aryl amine molecules.

13. A component in accordance with claim 1 wherein said charge transport is comprised of hole transport molecules comprised of

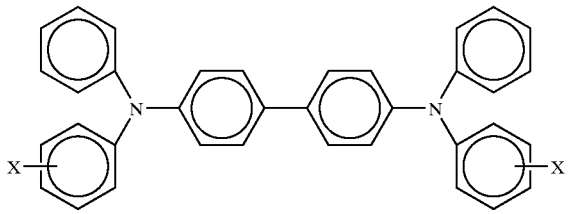

wherein X is selected from the group consisting of alkyl and halogen.

14. A component in accordance with claim 1 wherein alkyl contains from about 1 to about 25 carbon atoms.

15. A component in accordance with claim 1 wherein aryl contains from about 6 to about 48 carbon atoms.

16. A component in accordance with claim 1 wherein alkyl is methyl.

17. A component in accordance with claim 1 wherein aryl is phenyl or naphthyl.

18. A component in accordance with claim 1 wherein said aryl is anthracyl.

19. A component in accordance with claim 1 wherein said layer comprises

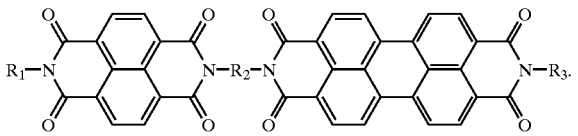

20. A component in accordance with claim 1 wherein said layer comprises

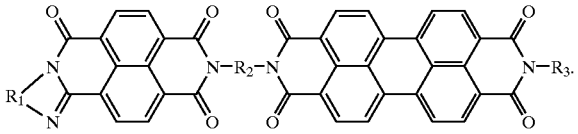

21. A component in accordance with claim 1 wherein said layer comprises

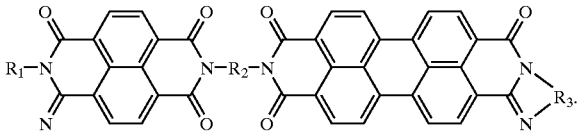

22. A component in accordance with claim 1 wherein said layer comprises

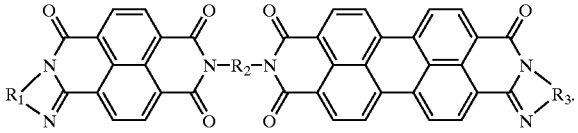

23. A method of imaging which comprises generating an electrostatic latent image on the component of claim 1, developing the latent image, and transferring the developed electrostatic image to a suitable substrate.

24. A method of imaging in accordance with claim 23 wherein the imaging member is exposed to light of a wavelength of from about 370 to about 425 nanometers.

25. An imaging apparatus containing a charging component, a development component, a transfer component, and a fixing component, and wherein said apparatus contains a photoconductive imaging member comprised of supporting substrate, and thereover the components of claim 1, and wherein said component is a photoconductor.

26. A photoconductive imaging component in accordance with claim 1 further containing an adhesive layer and a hole blocking layer.

27. A photoconductive imaging component member in accordance with claim 26 further containing said blocking layer contained as a coating on a substrate, and wherein said adhesive layer is coated on said blocking layer.

28. A photoconductive imaging component in accordance with claim 1 wherein each of said Rs are a polycyclic aromatic.

29. A photoconductor comprised of a charge transport layer and a photogenerator layer of at least one of

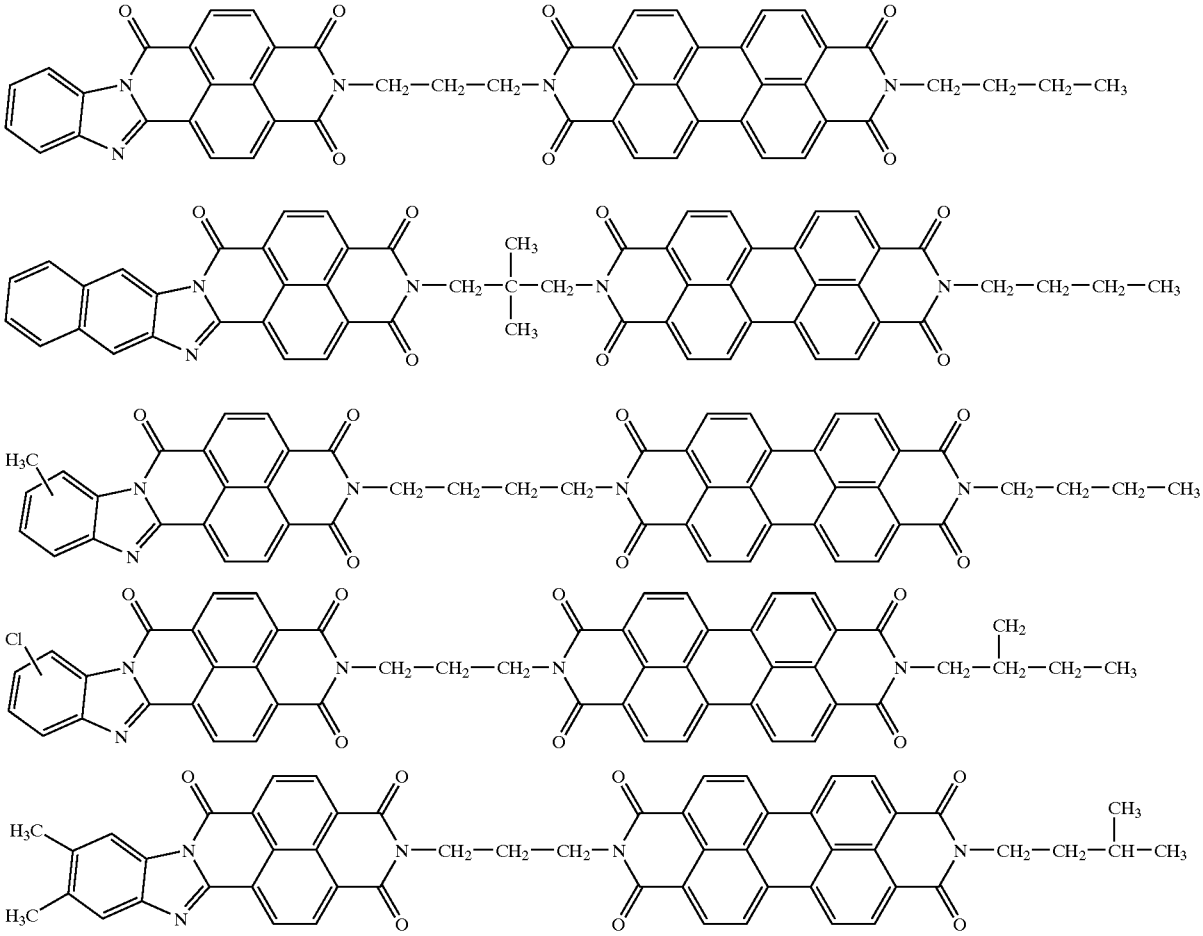

-continued

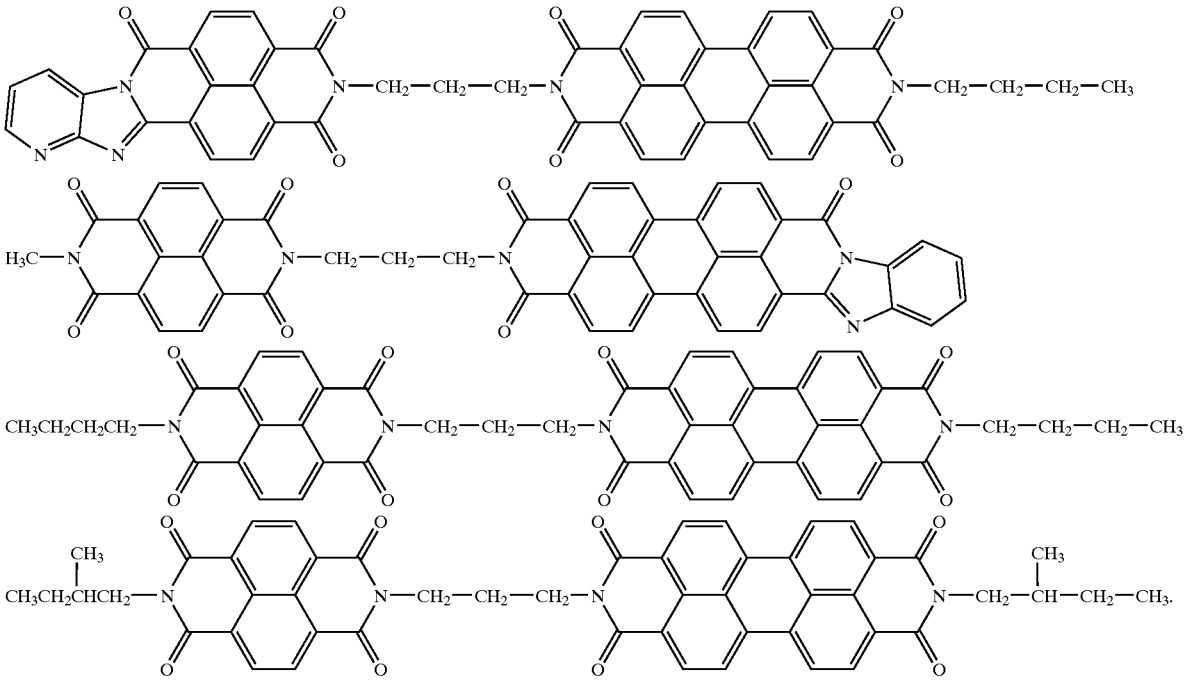

30. A photoconductor in accordance with claim 29 where said layer comprises

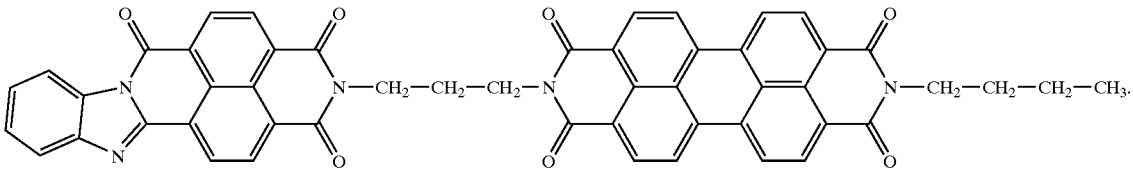

31. A component in accordance with claim 1 wherein $R_1$ is a substituted or unsubstituted alkyl, a branched alkyl, or alternatively a cycloalkyl; $R_2$ is alkyl, a branched alkyl, a cycloalkyl, or alternatively $R_1$; and $R_3$ is alkyl, a branched alkyl, or alternatively a cycloalkyl.

32. A component in accordance with claim 31 wherein $R_1$ is phenyl, naphthyl, or the higher polycyclic aromatic anthracene; $R_2$ is alkyl, a branched alkyl, a cycloalkyl, phenyl, naphthyl, or the higher polycyclic aromatic anthracene; and $R_3$ is alkyl, a branched alkyl, a cycloalkyl, phenyl, or naphthyl.

33. A component in accordance with claim 1 wherein said layer is an alkylimido-monobenzamidazole-perinone-perylene.

34. A component in accordance with claim 1 wherein said layer is a bisalkylimido-perinone-perylene.

35. A component comprised of a supporting substrate, and thereover a layer comprised of an alkylimido-monobenzamidazole-perinone-perylene of the alternative following formulas

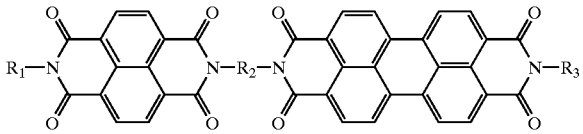

or

-continued

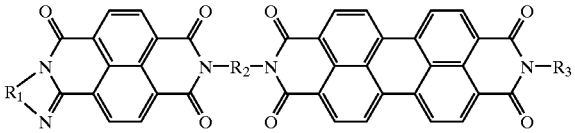

or

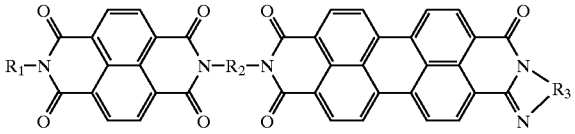

or

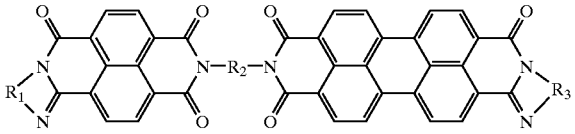

wherein each of $R_1$, $R_2$ and $R_3$ are independently alkyl or aryl, and a charge transport layer.

* * * * *